US005796046A

United States Patent [19]

Newmoyer et al.

[11] Patent Number: 5,796,046

[45] Date of Patent: Aug. 18, 1998

[54] COMMUNICATION CABLE HAVING A STRIATED CABLE JACKET

[75] Inventors: Kerry Newmoyer, Denver; Paul R. Freese, Mohnton; William P. Mulligan, Denver, all of Pa.

[73] Assignee: Alcatel NA Cable Systems, Inc., Claremont, N.C.

[21] Appl. No.: 670,801

[22] Filed: Jun. 24, 1996

[51] Int. Cl.[6] ..... H01B 7/02

[52] U.S. Cl. ..... 174/113 AS

[58] Field of Search ..... 174/113 R, 113 AS, 174/34, 116

[56] References Cited

U.S. PATENT DOCUMENTS

| | | | |
|---|---|---|---|
| 2,556,244 | 6/1951 | Weston | 174/113 R |
| 2,766,481 | 10/1956 | Henning | 264/45.9 |
| 2,804,494 | 8/1957 | Fenton | 174/113 AS |
| 3,086,557 | 4/1963 | Peterson | 174/113 R |
| 3,812,282 | 5/1974 | Johansson | 174/68.3 |
| 3,892,912 | 7/1975 | Hauck | 174/113 R |
| 5,132,488 | 7/1992 | Tessier et al. | 174/34 |
| 5,162,120 | 11/1992 | Baxter et al. | 425/113 |

FOREIGN PATENT DOCUMENTS

| | | |
|---|---|---|
| 524452 | 5/1956 | Canada . |
| 725624 | 3/1955 | United Kingdom . |
| 811703 | 4/1959 | United Kingdom . |

*Primary Examiner*—Kristine L. Kincaid
*Assistant Examiner*—Marc D. Machtinger
*Attorney, Agent, or Firm*—Ware, Fressola, Van Der Sluys & Adolphson LLP

[57] ABSTRACT

A communication cable includes a core of twisted pairs of electrical conductors and a cable jacket. The inner surface of the cable jacket includes a plurality of sharply angled striations disposed such that adjacent striations define sharply angled inwardly directed projections.

8 Claims, 2 Drawing Sheets

COMMUNICATION CABLE HAVING A STRIATED CABLE JACKET

BACKGROUND OF THE INVENTION

1. Field of the Invention

The present invention generally relates to a communication cable having a striated cable jacket and, in particular, relates to one such communication cable wherein the inner surface of the cable jacket includes a plurality of sharply angled striations disposed such that adjacent striations define sharply angled inwardly directed projections.

2. Description of the Prior Art

Typical communication cables include a plurality of electrical conductors surrounded by a cable jacket. One of the major concerns of cable manufacturers is the deleterious effects of capacitive coupling between the plurality of electrical conductors and the cable jacket. One general solution for reducing such coupling has been to include a layer of electrical shielding between the electrical conductors and the cable jacket. However, the communication industry has been moving away from these shielded cables toward a more cost effective, unshielded twisted pair cable (UTP).

It is generally well known that the cable jacket material used over the unshielded twisted pair cables affects the critical electrical parameters, such as, the impedance, the crosstalk, and the attenuation, of the cable. Without the conventional shielding, the amount of electrical coupling that occurs between the electrical conductors and the cable jacket is increased. Further, certain materials, such as Polyvinyl Chloride (PVC), Polyvinylidene Fluoride (PVDF), and polymer alloys have a particularly deleterious affect on these electrical parameters but are frequently used because of their cost effectiveness and/or their flame retardancy. At high frequencies the degradation of the electrical parameters accelerates as the coupling with the cable jacket increases. One solution to the problem of capacitive coupling between the electrical conductors and the cable jacket is to cause the cable jacket to become less intimate with the electrical conductors that it encases. Hence, the cross-sectional profile of the cable jacket and its spacing from the electrical conductors becomes an important consideration in the design of communication cables. The formation of the cable jacket over the electrical conductors is one of the primary parameters by which the cross-sectional profile of the cable jacket, and hence the electrical parameters of the communication cable, can be controlled. Typically, modern cable jackets are formed by an extrusion process.

Even in light of known techniques for the extrusion of a cable jacket over a plurality of electrical conductors, significant capacitive coupling between the electrical conductors and the material of the cable jacket remains a major problem. As mentioned above, one possible solution for reducing capacitive coupling between the cable jacket and the pairs of electrical conductors in the core of a cable is to cause the jacket to be loosely fitting over the core. This technique reduces the coupling and attenuation; however, this technique may increase impedance variations along the length of the cable. The loose fitting jacket does not hold the conductors tightly in place within the core, and the conductors in the core may shift and separate a small degree, thereby causing the impedance variations. These impedance variations lead to further losses in the cable and degraded signal quality.

Hence, it is highly desirable to provide a communication cable not only having reduced capacitive coupling between the electrical conductors and the cable jacket but providing such a communication cable that holds the pairs of electrical conductors in the core of the cable in the intended configuration to minimize impedance variation. It is also desirable to provide such a communication cable in a cost effective manner and which is useful with conventional materials.

SUMMARY OF THE INVENTION

Accordingly, it is an object of the present invention to provide a communication cable having reduced capacitive coupling between the electrical conductors thereof and the cable jacket.

It is a further object of the present invention to provide such a communication cable having reduced capacitive coupling which also maintains the pairs of electrical conductors in the core of a cable in an intended configuration to thereby minimize impedance variations in the communication cable.

According to the present invention, a communication cable includes a cable jacket wherein the inner surface of the cable jacket includes a plurality of sharply angled striations disposed such that adjacent striations define sharply angled inwardly directed projections.

According further to the present invention, the projections maintain pairs of electrical conductors in the core of a cable in an intended configuration.

According still further to the present invention, the communications cable may be manufactured by an extrusion head apparatus for forming a flowing jacket material into a cable jacket over a core, the extrusion head apparatus including: an extrusion head body having an opening therethrough; a manifold received within the opening and in communication with the flowing jacket material; an extrusion die received in an exit end of the extrusion head proximate an end of the manifold; a guider tip received in the manifold having a generally cylindrical body with a central passage therein for passage of the core therethrough, the guider tip further including a jacket forming surface on an outer surface thereof, the jacket forming surface including a plurality of complementary striations thereon such that adjacent striations define sharply angled outwardly directly projections; and wherein the jacket forming surface is spaced apart from the extrusion die, and wherein the manifold provides the flowing jacket material therebetween.

A communications cable manufactured in accordance with the present invention provides a significant improvement over the prior art. The projections on the internal surface of the cable jacket reduce the capacitive coupling between the cable jacket and the conductor pairs in the cable core because the cable jacket is less intimate with the cable core. Additionally, the projections maintain the conductor pairs within the core in the intended configuration to thereby minimize impedance variations.

Other objects and advantages of the present invention will become apparent to those skilled in the art from the following detailed description read in conjunction with the appended claims and the drawings attached hereto.

DESCRIPTION OF THE DRAWINGS

The drawings, not drawn to scale, include.

DETAILED DESCRIPTION OF THE PREFERRED EMBODIMENT

Figure 1:
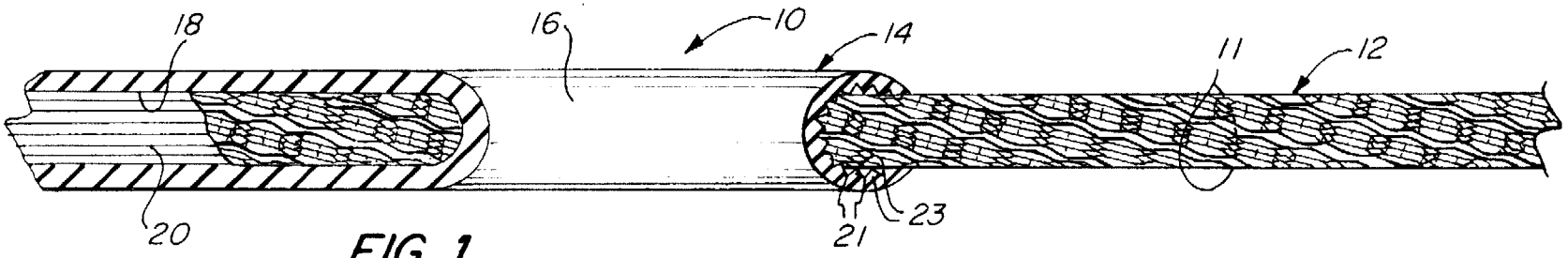
FIG. 1 which is perspective view, partially broken away, of a communication cable embodying the principles of the present invention.

A communication cable, generally indicated at 10 in FIG. 1 and embodying the principles of the present invention, includes a core 11 having a plurality of twisted pairs 12 of electrical conductors, a cable jacket 14 having an outer surface 16 and an inner surface 18, and means 20, integral with the inner surface 18, for spacing the inner surface 18 away from the plurality of twisted pairs 12 of electrical conductors.

In the preferred embodiment, each member of the twisted pairs 12 of electrical conductors preferably includes a single electrically conductive strand of metal surrounded by a separate layer of insulating material. Further, in one particular embodiment, the twisted pairs 12 are wound together. In one typical cable to which this invention is particularly applicable, there are between four (4) and twenty-five (25) twisted pairs in the cable core 11. Typically, the cable jacket can be formed from any known extrudable electrically insulating material, such as, for example, PVC, polymer alloys and fluropolymers such as Ethylenechlorotrifluorothylene (ECTF) and Fluroethylenepropylene (FEP). As shown in FIG. 1, the inner surface 16 of the cable jacket 14 is provided with means 20 for spacing the inner surface 16 away from the twisted pairs.

In one embodiment, the means 20 for spacing the inner surface away from the twisted pairs includes a plurality of sharply angled striations 21 disposed about the inner surface of the cable jacket such that adjacent striations define sharply angled inwardly directed projections 23. In one particular embodiment, there are about thirty-six (36) striations 21 equally spaced about the inner surface 20 of the cable jacket 14. That is, each individual striation subtends an angle of about ten (10) degrees. However, for a cable having four (4) twisted pairs of conductors 12 in the core 11, there may be between eighteen (18) and thirty-six (36) striations 21 equally spaced about the inner surface 20 of the cable jacket 14. Further, the peak-to-valley distance of the striations on the inner surface 20 of the cable jacket 14 is on the order of about 0.003 to 0.010 inches. In one preferred embodiment of the invention, the peak-to-valley distance of the striations is 0.005 inches.

As will be understood by those skilled in the art, the number of striations and the peak-to-valley distance of the striations may be varied, depending on the specific cable design. For example, the number of striations may be varied based upon the specific jacketing compound used and the dielectric properties, melt flow characteristics and hardness of the jacketing compound. Additionally, the number of striations may be varied depending upon the number of conductors 12 in the core 11.

With respect to the peak-to-valley distance of the striations, it will be understood by those skilled in the art that, generally speaking, the larger and sharper the striations, the greater the reduction in capacitive coupling between the jacket 14 and the conductors 12 in the core 11. However, factors such as the jacketing material used and cable size and handling must also be taken into consideration.

Figure 2:
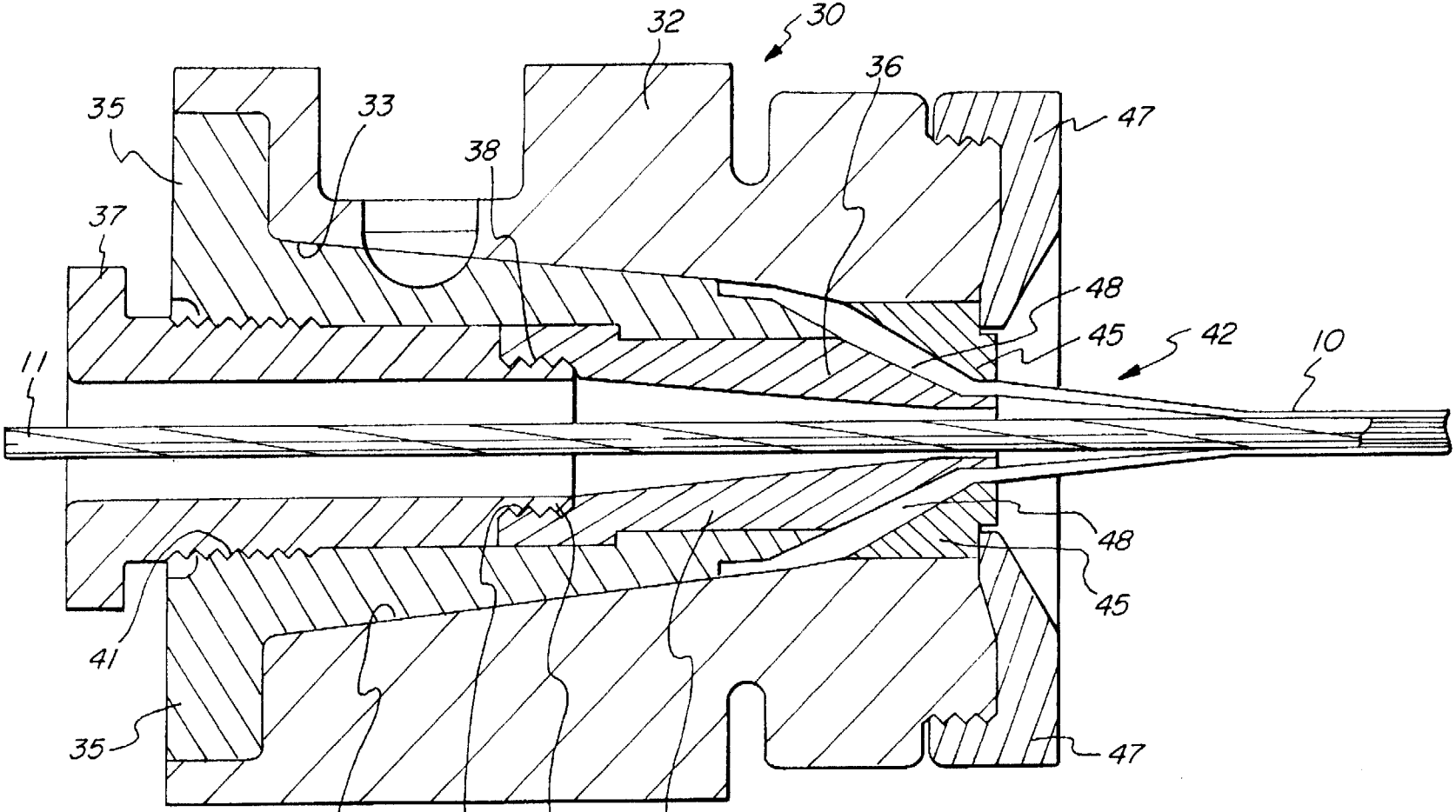
FIG. 2 which is a cross-sectional view of an extrusion head apparatus for use in the manufacture of communication cables in accordance with the principles of the present invention.

Preferably, the striations are formed on the inner surface of the cable jacket during the extrusion thereof using a unique extrusion arrangement. As shown in FIG. 2, an extrusion head apparatus 30 includes an extrusion head body 32 having an opening 33 therethrough. Received within the opening 33 is a manifold 35. The manifold 35 is also known as a flow divider or helicoid. The manifold 35 may be held in place within the extrusion head body 32 by suitable fastening means such as bolts (not shown) threaded into the head. Alternatively, other means may be used to hold the manifold 35 within the extrusion head body 32, such as a threaded collar.

The manifold 35 holds a wire guider tip 36 which is retained in place by a guider tip retention nut 37. The guider tip 36 and the guider tip retention nut 37 are cooperatively arranged within the manifold 35 to ensure that the core 11 of the cable 10 being jacketed, i.e., the twisted pairs, is axially aligned with the opening 33 within the extrusion head body 32. In the embodiment shown, the guider tip 36 is provided with threads 38 for threaded engagement with one end 40 of the guider tip retention nut 37. The guider tip retention nut 37 is provided with threads 41 for threaded engagement with the manifold 35.

As shown, the guider tip 36 extends proximate an exit end 42 of the extrusion head body 32 and is spaced apart from an extrusion die 45 retained at the exit end 42 by an adjusting mechanism 47. As shown, the adjusting mechanism 47 is threaded onto the exit end 42 of the extrusion head body 32. The position of the extrusion die 45 within the opening 33 in the extrusion head body 32 is adjusted by the adjusting mechanism 47. As a result, the spacing (area) 48 between the guider tip 36 and the extrusion die 45, and thus, the thickness of the cable jacket 14, can be adjusted. In operation, the core 11 of the cable 10 is axially fed through the guider tip retention nut 37, the guider tip 36, and finally, through the extrusion die 45. As will be understood by those skilled in the art, pressurized flowable jacketing material is provided from the manifold in the area 48 between the guider tip 36 and the extrusion die 45. The flowable jacketing material is maintained under sufficient pressure such that it is forced through the area 48 and passes between the extrusion die 45 and guider tip 36 to form the cable jacket 14, all in the way known in the art.

Figure 4:
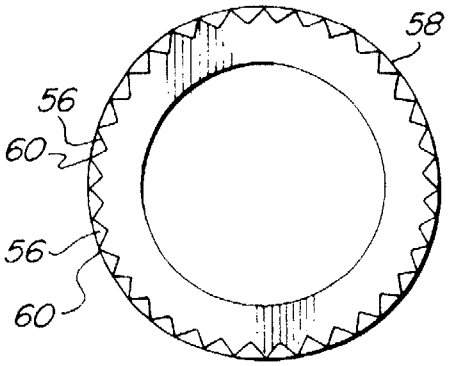
FIG. 4 which is an end view of the guider tip of FIG. 3.
Figure 3:
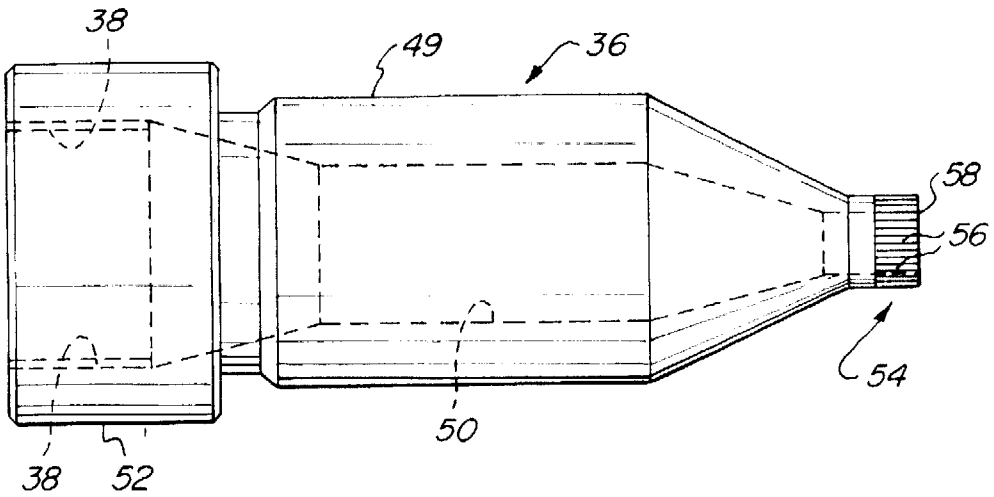
FIG. 3 is a perspective view of a guider tip used in the extrusion head apparatus of FIG. 2, and useful in the manufacture of communication cables in accordance with the principles of the present invention.

Referring also to FIGS. 3 and 4, the guider tip 36 has a generally cylindrical body 49 with a central passage 50 (shown in phantom) therein for passage of the core 11 therethrough. As discussed above, one end 52 of the guider tip 36 is provided with internal threads 38 for threaded engagement with the guider tip retention nut 37. The other end 54 of the guider tip 36 is provided with a set of complementary striations 56 about a cylindrical tip 58 thereof. These striations 56 are formed by known machining techniques. The striations 56 are formed about the outer surface of the cylindrical tip 58 such that adjacent striations 56 define sharply angled outwardly directed projections 60. Hence, as the flowable material of the cable jacket flows over the cylindrical tip 58 of the guider tip 36 (in the area 48 between the guider tip 36 and the extrusion die 45), the striations 21 and projections 23 (FIG. 1) are formed on the cable jacket inner surface 20 (FIG. 1) by the complementary projections 60 and striations 56 of the guider tip 36, respectively. As is well known in the cable art, the jacket material 16 is heated so that it flows through the extrusion head apparatus 30 and cools almost immediately upon leaving the extrusion head apparatus 30. Thus, the cable jacket 16 is formed about the core 11 upon the material leaving the extrusion head body 32.

As the cable jacket material exits the extrusion head apparatus 30 and cools, its shrinks down around the cable core 11 (FIG. 1) to thereby form the cable jacket 14. In order to form the striations having a peak-to-valley distance in the range of approximately 0.003 to 0.010 inches, the striations 56 and projections 60 on the tip 58 have a peak-to-valley distance in the range of approximately 0.005 to 0.025 inches. In one embodiment of the invention, the tip 58 is provided with striations 56 and projections 60 having a peak-to-valley distance of 0.007 inches.

Although the cable jacket is described herein as having sharply angled striations and projections on the inner surface thereof, it will be understood by those skilled in the art that other configurations may be used on the inner surface of the jacket in accordance with the invention. All that is required is that projections be formed on the inner surface of the jacket to generally maintain separation between the cable jacket and the pairs of electrical conductors in the core of the cable. Preferably, the projections maintain the pairs of electrical conductors in the intended position within the core of the cable. The sharply angled striations and projections minimize the contact between the cable jacket and the conductors; however, other configurations which minimize contact between the cable jacket and conductors may be used in accordance with the invention.

Although the present invention has been described herein with respect to exemplary embodiments thereof, other configurations and arrangements may be contemplated that do not exceed the spirit and scope of this invention. Hence, the present invention is deemed limited only by the appended claims and the reasonable interpretation thereof.

What is claimed is:

1. A communication cable, comprising:

a core including a plurality of electrical conductors, each conductor of said plurality of electrical conductors having a layer of electrical insulation thereon; and a cable jacket, said cable jacket encasing said plurality of electrical conductors along the length thereof and having an inner surface proximate said plurality of electrical conductors, said inner surface including a plurality of sharply angled striations disposed such that adjacent striations define sharply angled inwardly directed projections, said projections maintaining said electrical conductors in said core and out of said striations.

2. A communication cable according to claim 1 wherein said striations are formed longitudinaly along the entire length of said cable jacket.

3. A communication cable according to claim 1 wherein there are approximately 18 to 36 of said striations equally spaced around said inner surface with each striation subtending an angle of approximately 10° to 20°.

4. A communication cable according to claim 3 wherein a peak-to-valley distance of said striations is approximately 0.005 inches.

5. A communication cable according to claim 1 wherein a peak-to-valley distance of said striations is between 0.003 and 0.010 inches.

6. A communication cable according to claim 1 wherein there are between 18 and 36 of said striations equally spaced around said inner surface.

7. A communication cable according to claim 6 wherein a peak-to-valley distance of said striations is between 0.003 and 0.010 inches.

8. A communication cable according to claim 1 wherein said striations are formed entirely around said inner surface.

* * * * *

US005796046C1

(12) EX PARTE REEXAMINATION CERTIFICATE (6958th)

United States Patent
Newmoyer et al.

(10) Number: US 5,796,046 C1
(45) Certificate Issued: Jul. 28, 2009

(54) COMMUNICATION CABLE HAVING A STRIATED CABLE JACKET

(75) Inventors: Kerry Newmoyer, Denver, PA (US); Paul R. Freese, Mohnton, PA (US); William P. Mulligan, Denver, PA (US)

(73) Assignee: Nexans, Inc., Hickory, NC (US)

Reexamination Request:
No. 90/008,947, Dec. 10, 2007

Reexamination Certificate for:

| | |
|---|---|
| Patent No.: | **5,796,046** |
| Issued: | **Aug. 18, 1998** |
| Appl. No.: | **08/670,801** |
| Filed: | **Jun. 24, 1996** |

(51) Int. Cl.
*H01B 7/02* (2006.01)

(52) U.S. Cl. ..... 174/113 AS; 174/113 R; 174/34; 174/116

(58) Field of Classification Search ..... None
See application file for complete search history.

(56) References Cited

FOREIGN PATENT DOCUMENTS

| | | |
|---|---|---|
| DE | 1415474 | 9/1959 |
| GB | 725624 | 6/1954 |
| GB | 925213 | 11/1959 |

*Primary Examiner*—Linh My Nguyen

(57) ABSTRACT

A communication cable includes a core of twisted pairs of electrical conductors and a cable jacket. The inner surface of the cable jacket includes a plurality of sharply angled striations disposed such that adjacent striations define sharply angled inwardly directed projections.

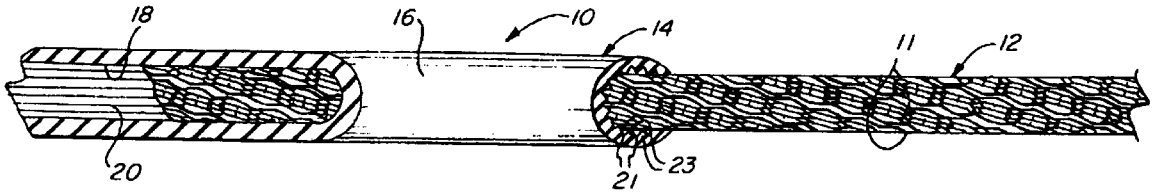

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–8 were not reexamined.

1. A communication cable *operating at high frequencies*, comprising:

a core including a plurality of *twisted pair* electrical conductors, each conductor of said plurality of *twisted pair* electrical conductors having a layer of electrical insulation thereon; and a cable jacket, said cable jacket encasing said plurality of electrical conductors along the length thereof and having an inner surface proximate said plurality of electrical conductors, said inner surface including a plurality of sharply angled striations *having peak to valley distances sufficient for reduction of signal attenuation caused by said cable jacket at said high frequencies, said striations* disposed such that adjacent striations define sharply angled inwardly directed projections, said projections maintaining said electrical conductors in said core and out of said striations.

* * * * *